US010932571B2

(12) United States Patent
Kolberg et al.

(10) Patent No.: US 10,932,571 B2
(45) Date of Patent: Mar. 2, 2021

(54) ROTATABLE CHAIR BACK

(71) Applicant: OFS Brands Holdings, Inc., Huntingburg, IN (US)

(72) Inventors: Justus Kolberg, Hamburg (DE); John Phillips, Huntington Beach, CA (US)

(73) Assignee: OFS BRANDS HOLDINGS INC., Huntingburg, IN (US)

( * ) Notice: Subject to any disclaimer, the term of this patent is extended or adjusted under 35 U.S.C. 154(b) by 0 days.

(21) Appl. No.: 16/426,452

(22) Filed: May 30, 2019

(65) Prior Publication Data

US 2019/0365102 A1 Dec. 5, 2019

Related U.S. Application Data

(60) Provisional application No. 62/678,408, filed on May 31, 2018.

(51) Int. Cl.
*A47C 3/025* (2006.01)
*A47C 7/44* (2006.01)
*A47C 1/032* (2006.01)

(52) U.S. Cl.
CPC ..... *A47C 3/025* (2013.01); *A47C 1/03255* (2013.01); *A47C 7/44* (2013.01)

(58) Field of Classification Search
CPC ..... A47C 3/025; A47C 1/03255; A47C 1/032; A47C 1/031; A47C 7/44; A47C 7/441
USPC ..... 297/302.1
See application file for complete search history.

(56) References Cited

U.S. PATENT DOCUMENTS

2002/0190552 A1* 12/2002 Koepke ..... A47C 7/282 297/284.7
2007/0108821 A1* 5/2007 Ueda ..... A47C 1/03261 297/301.1
2007/0108822 A1* 5/2007 Ueda ..... A47C 1/03261 297/301.6
2008/0231095 A1* 9/2008 Brauning ..... A47C 1/03272 297/219.1
2010/0237679 A1* 9/2010 Tsukiji ..... A47C 7/282 297/452.18
2011/0193385 A1* 8/2011 Gorgi ..... A47C 1/03205 297/313
2014/0077542 A1* 3/2014 Vander Veen ..... A47C 3/30 297/228.11
2014/0077548 A1* 3/2014 Peterson ..... A47C 1/032 297/284.4
2014/0125104 A1* 5/2014 Hasegawa ..... A47C 1/03255 297/303.4
2016/0150885 A1* 6/2016 Peterson ..... A47C 1/023 297/408
2016/0360887 A1* 12/2016 Davis ..... A47C 1/03261
2019/0167007 A1* 6/2019 Deevers ..... A47C 7/46
2019/0313802 A1* 10/2019 Zhou ..... A47C 7/465

* cited by examiner

*Primary Examiner* — Mark R Wendell
(74) *Attorney, Agent, or Firm* — Dentons Bingham Greenebaum LLP; Brian W. Chellgren

(57) ABSTRACT

A rotatable chair back includes a lower section attachable to a chair seat, a flexible Y-shaped upper section for supporting a chair back frame, and two rigid supports extending substantially vertically into and between the upper section and the lower section. In use, the substantially vertical supports each serve as an axis of rotation about which the upper section may rotate relative to the lower section.

13 Claims, 7 Drawing Sheets

ROTATABLE CHAIR BACK

CROSS-REFERENCE TO RELATED APPLICATION

This application claims the benefit of U.S. provisional patent application Ser. No. 62/678,408, filed May 31, 2018, for ROTATABLE CHAIR BACK, incorporated herein by reference.

FIELD OF THE INVENTION

A rotatable chair back includes a lower section attachable to a chair seat, a flexible Y-shaped upper section for supporting a chair back frame, and two rigid supports extending substantially vertically into and between the upper section and the lower section. In use, the substantially vertical supports each serve as an axis of rotation about which the upper section may rotate relative to the lower section.

BACKGROUND OF THE INVENTION

Typical office chairs include a generally planar chair seat extending substantially horizontally, a generally planar chair back attached to the chair seat and extending substantially perpendicular to the chair seat, a central support positioned beneath and supporting the chair seat, a plurality of legs extending from the lower end of the central support, and a plurality of wheels, each wheel being located at the distal end of a leg. When a seated worker wishes to speak with a co-worker located at the worker's sides or reach an object located to his or her left or right, the seated worker may rotate the chair seat horizontally about the central support to facilitate reaching the object or facing the co-worker.

An office worker may sit on a typical office chair while seated at an executive desk. A typical executive desk includes a flat horizontal surface supported by a pair of spaced apart cabinets, with the worker's legs fitting in the space between the cabinets and below the desk. If the worker wishes to speak with co-workers located at the worker's sides or reach an object located to his or her left or right, rotation of the chair seat horizontally may result in the worker's knees painfully contacting the nearby cabinets. A need exists for a chair which allows a seated worker to rotate his or her torso while being supported by a chair back, independent of the rotation of the chair seat.

SUMMARY

A rotatable chair back includes a rigid J-shaped lower section attachable to a chair seat, a Y-shaped upper section for supporting a chair back, and at least one rigid support extending substantially vertically into and between the upper section and the lower section. In use, the at least one substantially vertical support serves as an axis of rotation about which the upper section may rotate horizontally.

This rotatable chair back encourages motion in the seated worker by enabling his or her upper torso to rotate either left or right, thus increasing mobility and allowing the seated worker to adjust his or her posture in order to respond to, or interact with, others from a seated position, or to reach objects located to the seated worker's sides. In an increasingly interactive workplace where people are communicating frequently, the increased seated freedom of motion encourages supported flexure or twisting of the torso to provide the seated worker with increased comfort and support as they turn to interact and respond with their co-workers, or to reach objects located to the seated worker's sides.

In some embodiments, a chair back comprises a chair back frame, an upper section including a base portion and an arm portion extending from the base portion, wherein the arm portion is attached to the chair back frame, a substantially rigid lower section adapted to support the base portion of the upper section relative to a chair seat, and a rigid support extending between the upper section and the lower section, wherein the upper section is rotatable relative to the lower section about the rigid support. In further embodiments, the arm portion extends from the base portion at an angle. In certain embodiments, the angle is greater than 0 degrees and less than 90 degrees. In some embodiments, the lower section is substantially J-shaped and includes a substantially straight portion and a bent portion. In further embodiments, the substantially straight portion is adapted to attach to the chair seat and wherein the bent portion is adapted to support the upper section. In certain embodiments, the upper section includes a left upper section member and a right upper section member. In some embodiments, the base portion of the left upper section member is supported by the lower section and the arm portion of the left upper section is attached to the chair back frame, and the base portion of the right upper section member is supported by the lower section and the arm portion of the right upper section is attached to the chair back frame. In further embodiments, the upper section is substantially horizontally rotatable relative to the lower section about the rigid support. In certain embodiments, the upper section is formed, at least in part, of a flexible material. In some embodiments, the chair back further includes an upper section cavity and a corresponding lower section cavity, and wherein an end of the support is located within the upper section cavity and an opposite end of the support is located within the lower section cavity.

In further embodiments, a chair back comprises a chair back frame, an upper section including a left upper section member and a right upper section member, each of the left upper section member and right upper section member including a base portion and an arm portion extending from the base portion, wherein each arm portion is attached to the chair back frame, a substantially rigid lower section adapted to support the bases of each of the left upper section member and the right upper section member relative to a chair seat, a first rigid support extending substantially vertically between the left upper section member and the lower section, and a second rigid support extending substantially vertically between the right upper section member and the lower section, wherein the upper section is rotatable relative to the lower section about the first and second rigid supports. In a further embodiment, the upper section is formed, at least in part, of a flexible material. In certain embodiments, each arm portion extends from the base portion at an angle greater than 0 degrees and less than 90 degrees.

In certain embodiments, a chair comprises a chair seat and a chair back attached to the chair seat, the chair back including a chair back frame, an upper section including a left upper section member and a right upper section member, each of the left upper section member and right upper section member including a base portion and an arm portion extending from the base portion, wherein each arm portion is attached to the chair back frame, a substantially rigid lower section adapted to support the bases of each of the left upper section member and the right upper section member relative to the chair seat, a first rigid support extending substantially vertically between the left upper section member and the lower section, and a second rigid support extending substantially vertically between the right upper section member and the lower section, wherein the upper section is rotatable relative to the lower section about the first and second rigid supports.

It will be appreciated that the various apparatus and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

A better understanding of the present invention will be had upon reference to the following description in conjunction with the accompanying drawings.

DETAILED DESCRIPTION OF THE PREFERRED EMBODIMENTS

Figure 1:
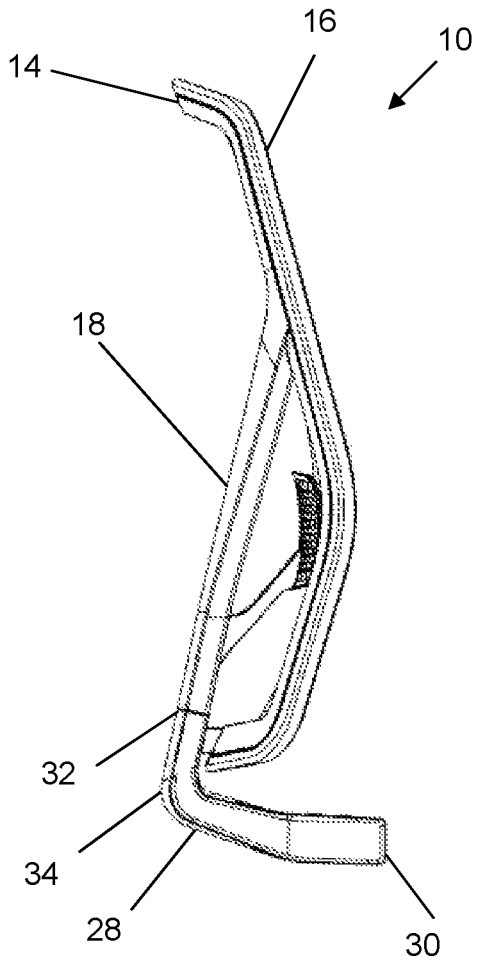
FIG. 1 is a right side view of a first embodiment of a chair back.
Figure 2A:
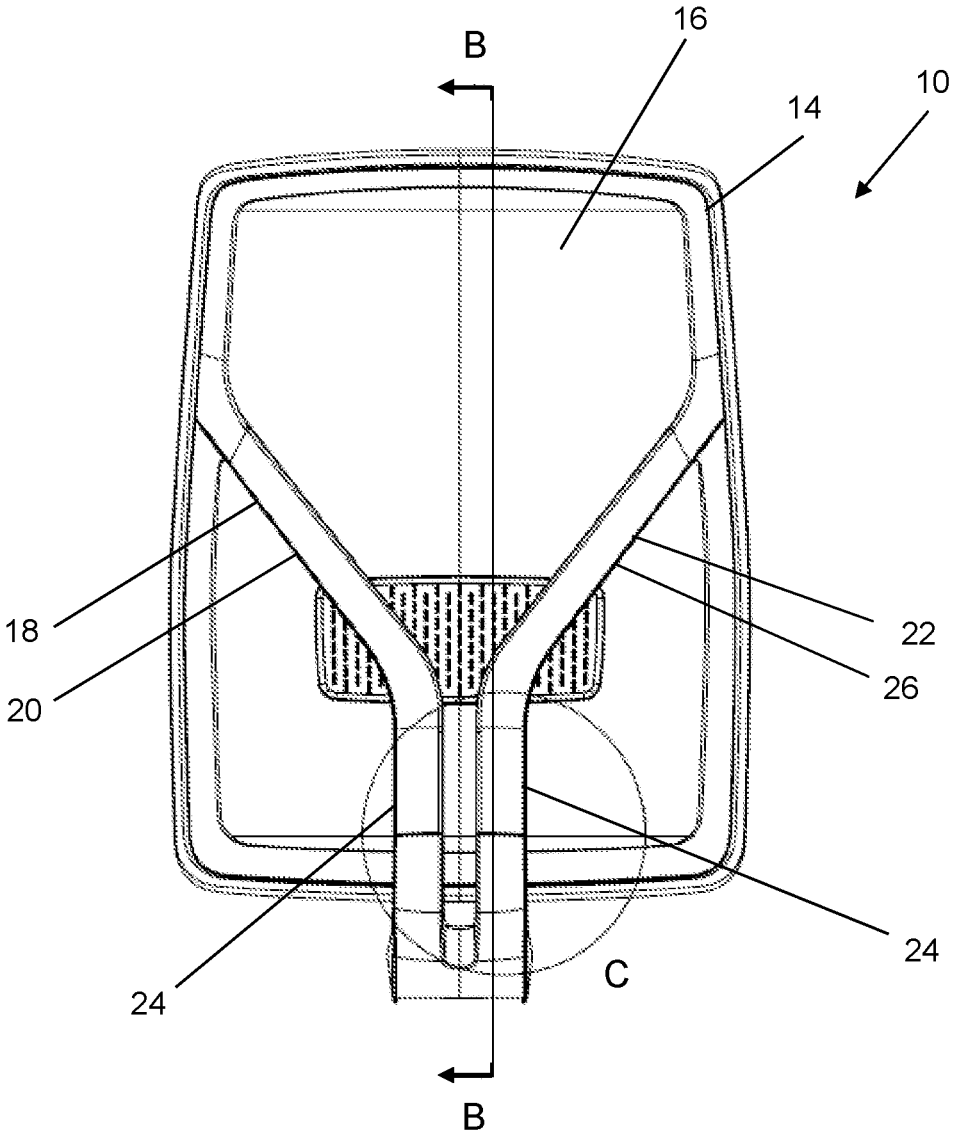
FIG. 2A is a rear view of the chair back of FIG. 1.
Figure 2B:
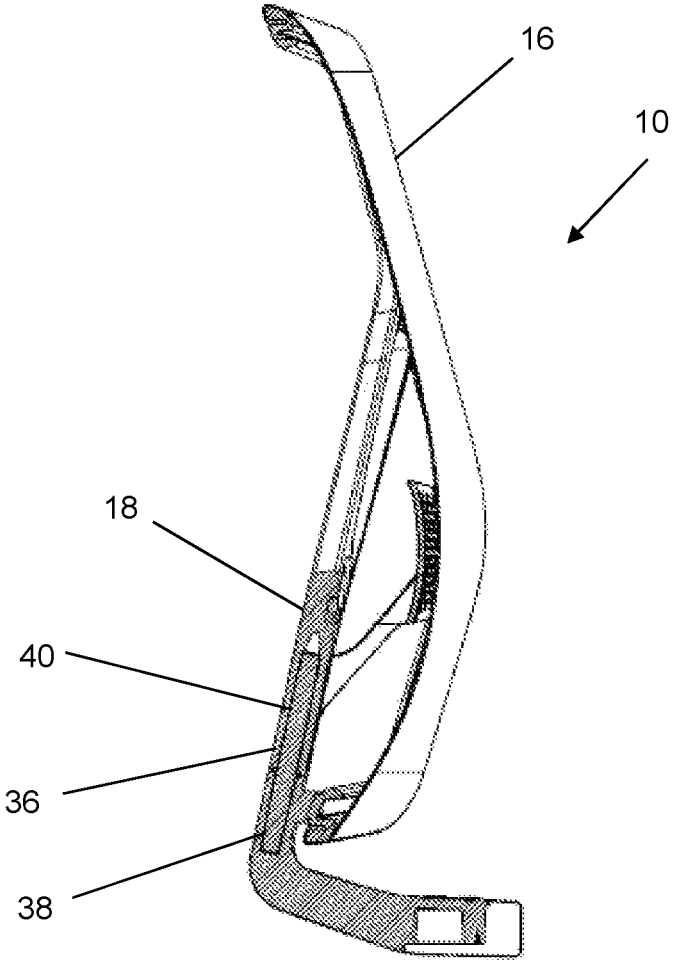
FIG. 2B is a cross-sectional right side view of the chair back along line B-B of FIG. 2A.
Figure 2C:
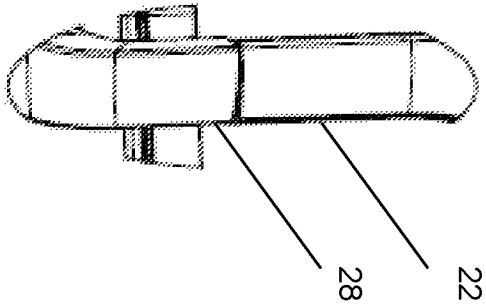
FIG. 2C is a rear view of area C of FIG. 2A, with the upper section slightly rotated with respect to the lower section.
Figure 3:
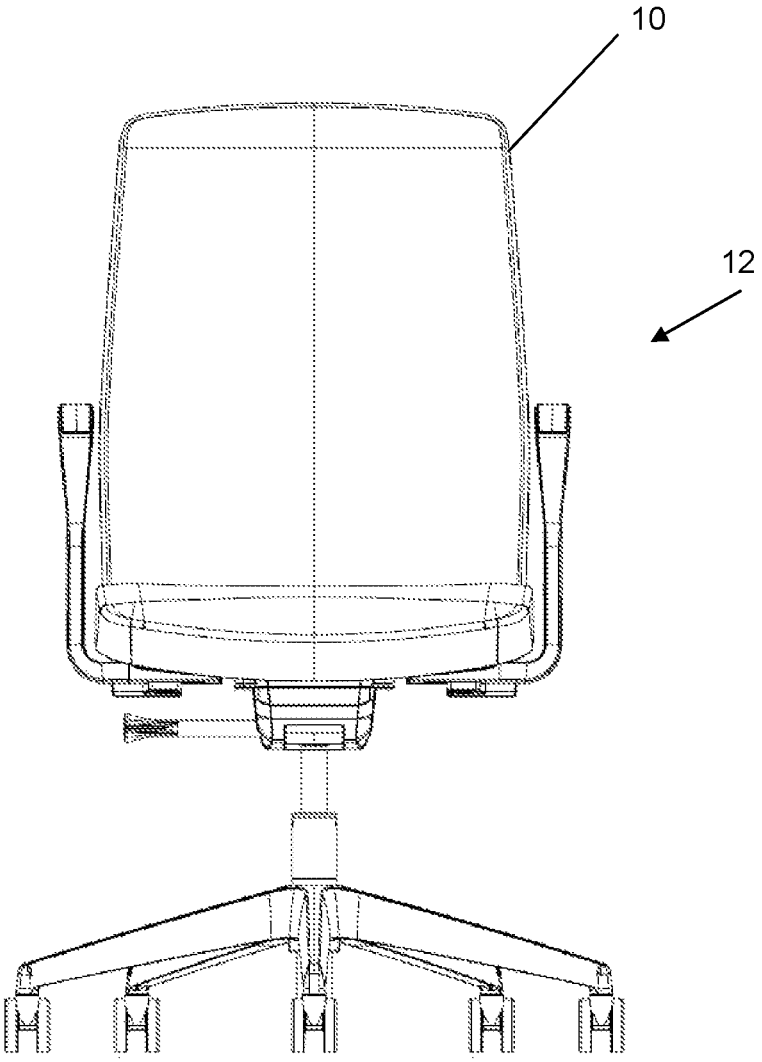
FIG. 3 is a front view of a chair including the chair back of FIG. 1.
Figure 4:
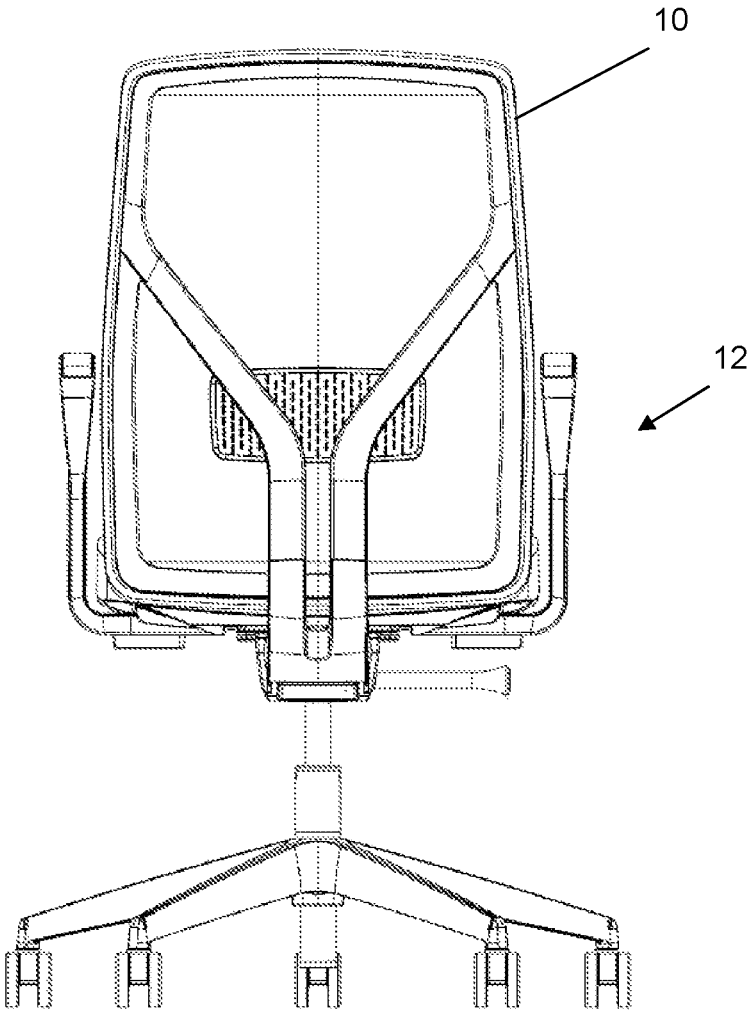
FIG. 4 is a rear view of the chair of FIG. 3.
Figure 5:
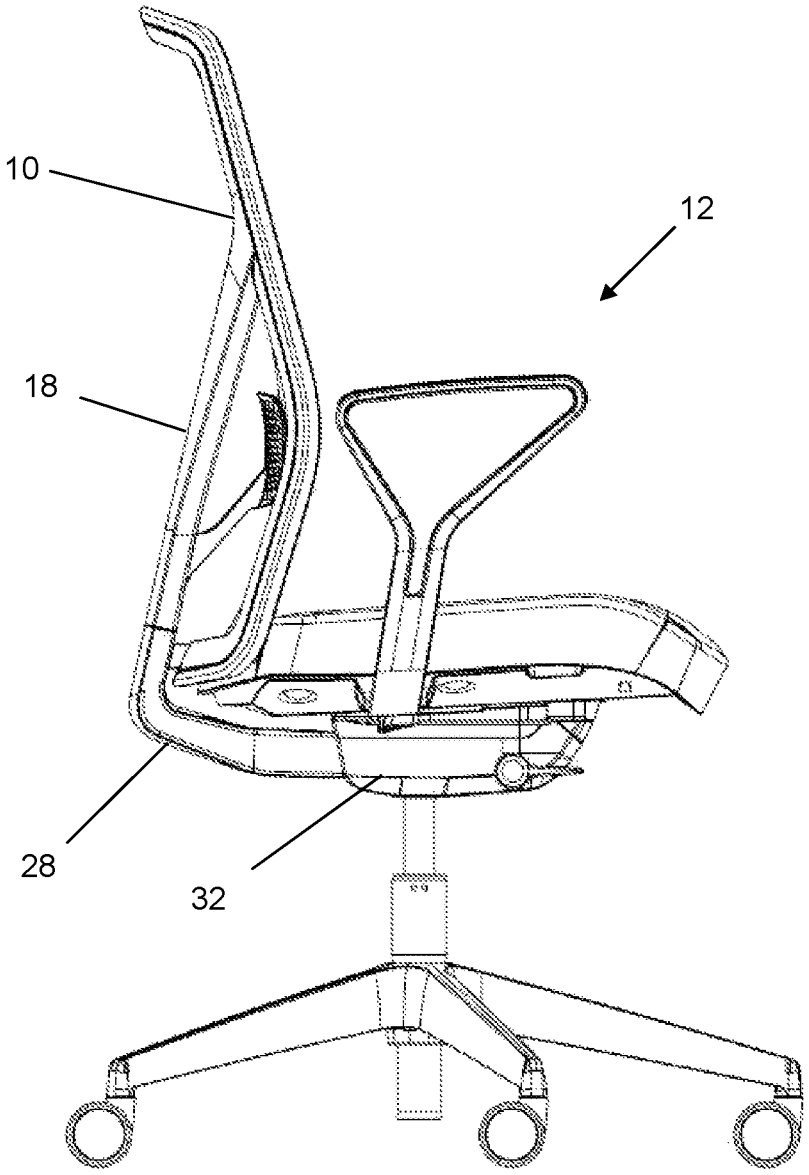
FIG. 5 is a right side view of the chair of FIG. 3.

A first embodiment of a chair back 10 is shown in FIGS. 1A-2C, and is shown incorporated in a chair 12 in FIGS. 3-5. The chair back 10 includes a chair back frame 14 extending around the periphery of the chair back support 16. In the depicted embodiment, the chair back frame 14 is substantially rectangular in shape when viewed from the front or rear. In other embodiments, the chair back frame 14 may be other geometric or non-geometric shapes. The chair back frame 14 may be formed of an injection-molded nylon and glass-filled plastic composite, or other suitable material.

The chair back 10 further includes a resilient upper section 18. In the depicted embodiment, as most easily seen in FIGS. 2A and 4, the upper section 18 includes a left upper section member 20 and a right upper section member 22. Each upper section member 20, 22 includes a base portion 24 and an arm portion 26 extending at an angle to the base portion 24, such that the base portion 24 and arm portion 26 are not parallel to each other. In some embodiments, the angle is greater than 0 degrees and less than 90 degrees.

The left upper section member 20 and right upper section member 22 are positioned such that their base portions 24 are substantially parallel to each other and their arm portions 26 extend in opposite directions, such that the upper section 18 is generally Y-shaped. Each arm portion 26 is attached to and supports the chair back frame 14. The upper section 18 is formed, at least in part, of a flexible, resilient material. In some embodiments, the upper section 18 may be formed of the same material as the chair back frame 14, or may be formed of another suitable material. In certain embodiments, the upper section 18 is integral to the chair back frame 14.

The chair back further includes a substantially rigid lower section 28. In the depicted embodiment, as most easily seen in FIGS. 1, 2B and 5, the lower section 28 is generally J-shaped, including a substantially straight portion 30 adapted to attach to a chair seat 32 and a bent portion 34 adapted to support the base portions 24 of each of the left upper section member 20 and right upper section member 22. The lower section 28 may be formed of the same material as the chair back frame 14, or may be formed of another suitable substantially rigid material.

As shown in FIG. 2B, the base portion 24 of the left upper section member 20 and the base portion 24 of the right upper section member 22 each include a cavity 36 shaped to receive an end of a rigid elongated support 40. The lower section 28 includes a pair of corresponding cavities 38, each shaped to receive an opposite end of the elongated supports 40. A first rigid elongated support 40 extends substantially vertically between and into the cavity 36 in the left upper section member 20 and the corresponding lower section cavity 38. A second rigid elongated support 40 extends substantially vertically between and into the cavity 36 in the right upper section member 22 and the corresponding lower section cavity 38. The rigid elongated supports 40 mechanically couple the upper section 18 to the lower section 28. In some embodiments, the rigid elongated supports 40 are steel rods. In other embodiments, the rigid elongated supports 40 are rods formed of another suitability robust material.

As shown in FIG. 2C, the right upper section member 22 is rotatable relative to the lower section 28 about its respective rigid elongated support 40. Similarly, the left upper section member 20 is rotatable relative to the lower section 28 about its respective rigid elongated support 40. As an individual sitting on the chair 12 rotates his or her torso left or right, the left upper section member 20 and right upper section member 22 are sufficiently resilient and flexible such that the base portion 24 of each upper section member 20, 22 rotates about their respective rigid elongated support 40. Using two separate spaced-apart rigid elongated supports 40 limits the rotation of each individual upper section member 20, 22 and prevents over-rotation or over-flexing, which could place undue strain on the upper section members 20, 22.

Certain features in the disclosed chair back 10 are described as "substantially vertical" or "substantially horizontal." These terms represent a range of angles and directions, as components of the chair back 10 may vary from purely vertical or purely horizontal for structural or aesthetic reasons. For example, the substantially vertical elongated support 40 shown in FIG. 2B is oriented approximately 12 degrees from a true vertical orientation. In some embodiments, a substantially vertical orientation is not more than 20 degrees, not more than 15 degrees, or not more than 12 degrees from a true vertical orientation. In some embodiments, a substantially horizontal orientation is not more than 20 degrees, not more than 15 degrees, or not more than 12 degrees from a true horizontal orientation.

The foregoing detailed description is given primarily for clearness of understanding and no unnecessary limitations are to be understood therefrom for modifications can be made by those skilled in the art upon reading this disclosure and may be made without departing from the spirit of the invention.

What is claimed is:

1. A chair back, comprising:

a chair back frame;

an upper section including an upper section cavity, a base portion and an arm portion extending from the base portion, wherein the arm portion is attached to the chair back frame;

a substantially rigid lower section including a lower section cavity, wherein the lower section is adapted to support the base portion of the upper section relative to a chair seat; and a rigid support extending between the upper section and the lower section, wherein an end of the support is located within the upper section cavity and an opposite end of the support is located within the lower section cavity;

wherein the upper section is rotatable relative to the lower section about the rigid support.

2. The chair back of claim 1, wherein the arm portion extends from the base portion at an angle.

3. The chair back of claim 2, wherein the angle is greater than 0 degrees and less than 90 degrees.

4. The chair back of claim 1, wherein the lower section is substantially J-shaped and includes a substantially straight portion and a bent portion.

5. The chair back of claim 4, wherein the substantially straight portion is adapted to attach to the chair seat and wherein the bent portion is adapted to support the upper section.

6. The chair back of claim 1, wherein the upper section includes a left upper section member and a right upper section member.

7. The chair back of claim 6, wherein the base portion of the left upper section member is supported by the lower section and the arm portion of the left upper section is attached to the chair back frame, and wherein the base portion of the right upper section member is supported by the lower section and the arm portion of the right upper section is attached to the chair back frame.

8. The chair back of claim 1, wherein the upper section is substantially horizontally rotatable relative to the lower section about the rigid support.

9. The chair back of claim 1, wherein the upper section is formed, at least in part, of a flexible material.

10. A chair back, comprising:

a chair back frame;

an upper section including a left upper section member and a right upper section member, each of the left upper section member and right upper section member including a base portion and an arm portion extending from the base portion, wherein each arm portion is attached to the chair back frame;

a substantially rigid lower section adapted to support the bases of each of the left upper section member and the right upper section member relative to a chair seat;

a first rigid support extending substantially vertically between the left upper section member and the lower section; and a second rigid support extending substantially vertically between the right upper section member and the lower section;

wherein the upper section is rotatable relative to the lower section about the first and second rigid supports.

11. The chair back of claim 10, wherein the upper section is formed, at least in part, of a flexible material.

12. The chair of claim 10, wherein each arm portion extends from the base portion at an angle greater than 0 degrees and less than 90 degrees.

13. A chair, comprising:

a chair seat; and a chair back attached to the chair seat, the chair back including:

a chair back frame;

an upper section including a left upper section member and a right upper section member, each of the left upper section member and right upper section member including a base portion and an arm portion extending from the base portion, wherein each arm portion is attached to the chair back frame;

a substantially rigid lower section adapted to support the bases of each of the left upper section member and the right upper section member relative to the chair seat;

a first rigid support extending substantially vertically between the left upper section member and the lower section; and a second rigid support extending substantially vertically between the right upper section member and the lower section;

wherein the upper section is rotatable relative to the lower section about the first and second rigid supports.

* * * * *